US009356397B2

(12) United States Patent
Hsu et al.

(10) Patent No.: US 9,356,397 B2
(45) Date of Patent: May 31, 2016

(54) CONNECTOR AND ELECTRONIC SYSTEM USING THE SAME

(75) Inventors: Chien-Ming Hsu, Taipei (TW); Kuo-Chu Liao, Taipei (TW); Chung-Yuan Kuang, Taipei (TW); Chiuan Jian Huang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 31 days.

(21) Appl. No.: 14/373,011

(22) PCT Filed: Jan. 19, 2012

(86) PCT No.: PCT/CN2012/070577

§ 371 (c)(1),
(2), (4) Date: Jul. 17, 2014

(87) PCT Pub. No.: WO2013/107020

PCT Pub. Date: Jul. 25, 2013

(65) Prior Publication Data

US 2015/0303621 A1 Oct. 22, 2015

(51) Int. Cl.
*H01R 13/648* (2006.01)
*H01R 13/6471* (2011.01)
(Continued)

(52) U.S. Cl.
CPC ..... *H01R 13/6471* (2013.01); *H01R 12/73* (2013.01); *H01R 13/6461* (2013.01); *H01R 13/405* (2013.01)

(58) Field of Classification Search
CPC ..... H01R 13/6471; H01R 12/73; H01R 13/6461; H01R 13/405
USPC ..... 439/607.05, 941
See application file for complete search history.

(56) References Cited

U.S. PATENT DOCUMENTS

| | | | | |
|---|---|---|---|---|
| 4,600,907 | A * | 7/1986 | Grellman et al. | 333/246 |
| 6,215,377 | B1 | 4/2001 | Douriet | |
| 2011/0161694 | A1 | 6/2011 | Fujiwara | |

FOREIGN PATENT DOCUMENTS

| | | |
|---|---|---|
| CN | 1723557 | 1/2006 |
| CN | 1774835 | 5/2006 |

(Continued)

OTHER PUBLICATIONS

International Search Report for PCT/CN12/070577 Aug. 20, 2012.

(Continued)

*Primary Examiner* — Javaid Nasri
(74) *Attorney, Agent, or Firm* — Bryan Cave LLP

(57) ABSTRACT

A connector and an electronic system using the same. The electronic system (100) comprises a first electronic device (102), a second electronic device (200), and a connector (104), the connector being used for connecting the first electronic device and the second electronic device. The first electronic device has a first plane (P10). The second electronic device has a second plane (P20). The first plane and the second plane are not coplanar. The connector comprises multiple terminals (110, 120, 130), electrically connected to the first plane and the second plane respectively. In the connector, a signal terminal is located between a first ground terminal and a second ground terminal, which is beneficial to transmission of a low-noise high-frequency signal in a shielded environment. The connector and the electronic system using the same may transmit a signal between different planes by connecting junctions in different planes.

12 Claims, 3 Drawing Sheets

(51) Int. Cl.

| | |
|---|---|
| ***H01R 12/73*** | (2011.01) |
| ***H01R 13/6461*** | (2011.01) |
| *H01R 13/405* | (2006.01) |

(56) References Cited

FOREIGN PATENT DOCUMENTS

| | | |
|---|---|---|
| CN | 201038541 | 3/2008 |
| CN | 201072838 | 6/2008 |
| CN | 101430592 | 5/2009 |
| CN | 101546918 | 9/2009 |
| CN | 101841107 | 9/2010 |
| CN | 101894054 | 11/2010 |
| CN | 101997253 | 3/2011 |
| CN | 102156524 | 8/2011 |
| EP | 0195520 | 9/1986 |
| EP | 2362719 | 8/2011 |
| JP | 61-222246 | 10/1986 |
| JP | 2002-517099 | 6/2002 |
| JP | 2005064362 | 3/2005 |
| JP | 2006073721 | 3/2006 |
| JP | 2008097806 | 4/2008 |
| WO | 2008-083167 | 7/2008 |

OTHER PUBLICATIONS

JP Office Action; Japanese and English Translation, Issued Mar. 6, 2015.

International Search Report and Written Opinion for PCT/CN2012/071765 dated, Nov. 8, 2012.

International Search Report and Written Opinion for PCT/CN2012/070577 dated, Aug. 20, 2012.

JP Office Action; Japanese and English Translation, Issued Jun. 30, 2015.

European Search Report, dated Sep. 2, 2015.

* cited by examiner

CONNECTOR AND ELECTRONIC SYSTEM USING THE SAME

CROSS-REFERENCE TO RELATED APPLICATIONS

This application is a national stage application under 35 U.S.C. 371 of and claims priority to International Application No. PCT/CN2012/070577, filed Jan. 19, 2012. International Application No. PCT/CN2012/070577 is incorporated herein by reference.

TECHNICAL FIELD OF THE INVENTION

The disclosure relates to a connector and an electronic system using the same and, more particularly, to a high frequency connector and an electronic system using the same.

BACKGROUND

Conventionally, coaxial cables are used as connectors in transmission of high frequency signals or connection of different electronic communication products. However, since the coaxial cable connector is larger and occupies much space, it is difficult to be applied to a small-sized portable electronic device (such as a phone). On the other hand, since the architecture of the coaxial cable connector is fixed and is not easy to be changed, it is difficult to be customized for various products. Moreover, the manufacturing cost of the coaxial cable connector is high.

In addition, a coplanar waveguide technology is another common conventional high frequency signal transmission technology. The coplanar waveguide technology has a feature that it includes a single plane of transmission lines, that means, a signal line and a grounding line are in the same plane, which makes electronic components connected to each other in series or parallel easily. Moreover, the coplanar waveguide technology makes electric characteristic of the electronic components not easily affected by the thickness of a dielectric plate. Consequently, the manufacturing cost of circuits is greatly reduced, and a circuit layout has more choices.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

In one embodiment, a connector used to connect a first electronic device and a second electronic device is provided. The connector includes a first grounding terminal, a signal terminal and a second grounding terminal. The signal terminal is between the first grounding terminal and the second grounding terminal. The first grounding terminal includes a first end and a second end, the signal terminal includes a third end and a fourth end, the second grounding terminal includes a fifth end and a sixth end. The first end, the third end and the fifth end are electrically connected to a first plane of the first electronic device. The second end, the fourth end and the sixth end are electrically connected to a second plane of the second electronic device. The first plane and the second plane are not coplanar.

In another embodiment, an electronic system including a first electronic device, a second electronic device and a connector is provided. The first electronic device includes a first plane. The second electronic device includes a second plane. The first plane and the second plane are not coplanar. The connector includes a first grounding terminal, a signal terminal and a second grounding terminal. The signal terminal is between the first grounding terminal and the second grounding terminal. The first grounding terminal includes a first end and a second end, the signal terminal includes a third end and a fourth end, the second grounding terminal includes a fifth end and a sixth end. The first end, the third end and the fifth end are electrically connected to a first plane. The second end, the fourth end and the sixth end are electrically connected to a second plane.

In an embodiment, the first grounding terminal, the signal terminal and the second grounding terminal are made of conducting materials.

In an embodiment, the first grounding terminal and the second grounding terminal are equipotential.

In an embodiment, the signal terminal is a high frequency signal terminal.

In an embodiment, the connector further includes a casing, the first grounding terminal, the signal terminal and the second grounding terminal are partially disposed inside the casing.

In an embodiment, the second electronic device includes an accommodation slot to accommodate the first electronic device.

In an embodiment, the first electronic device is an electronic communication product.

According to the connector and the electronic device disclosed, the signal terminal is transmitted between the first grounding terminal and the second grounding terminal, so as to transmit a high frequency signal with low noise at a shielding environment. In addition, the terminal of the connector can be adjusted easily to meets the customized requirements.

These and other features, aspects and advantages of the present disclosure will become better understood with regard to the following description, appended claims, and accompanying drawings.

Figure 1:
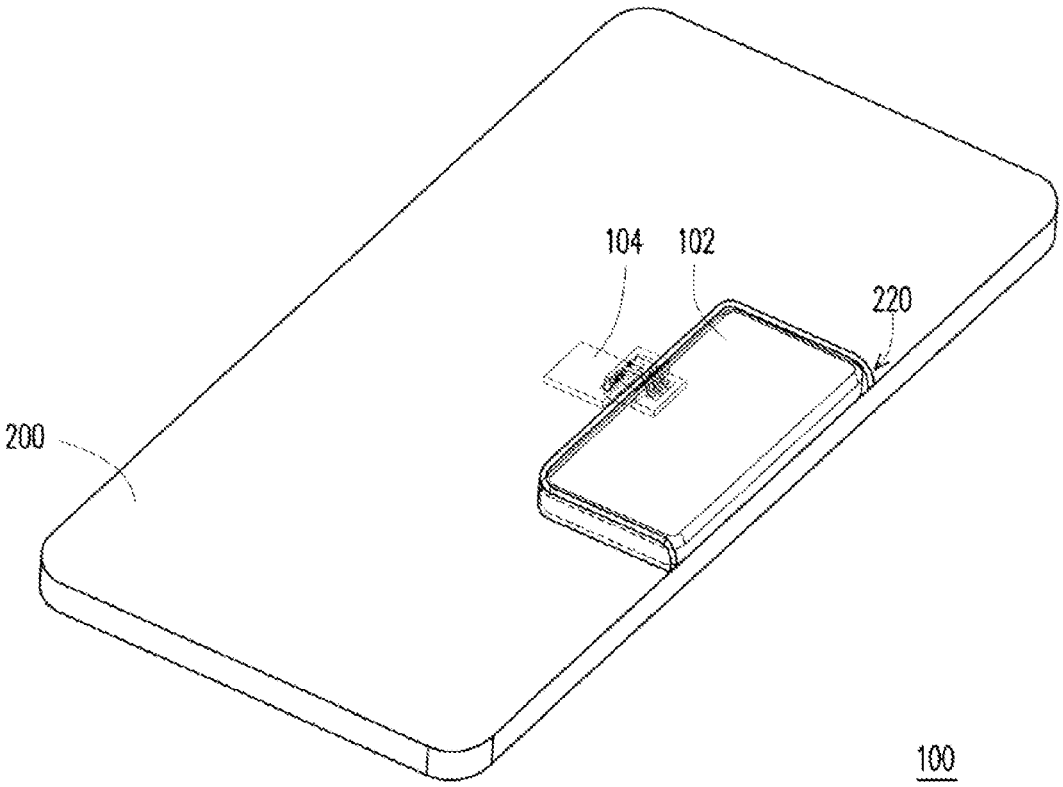
FIG. 1 is a partial perspective showing a first electronic device of an electronic system is electrically connected to a second electronic device via a connector in an embodiment.
Figure 2:
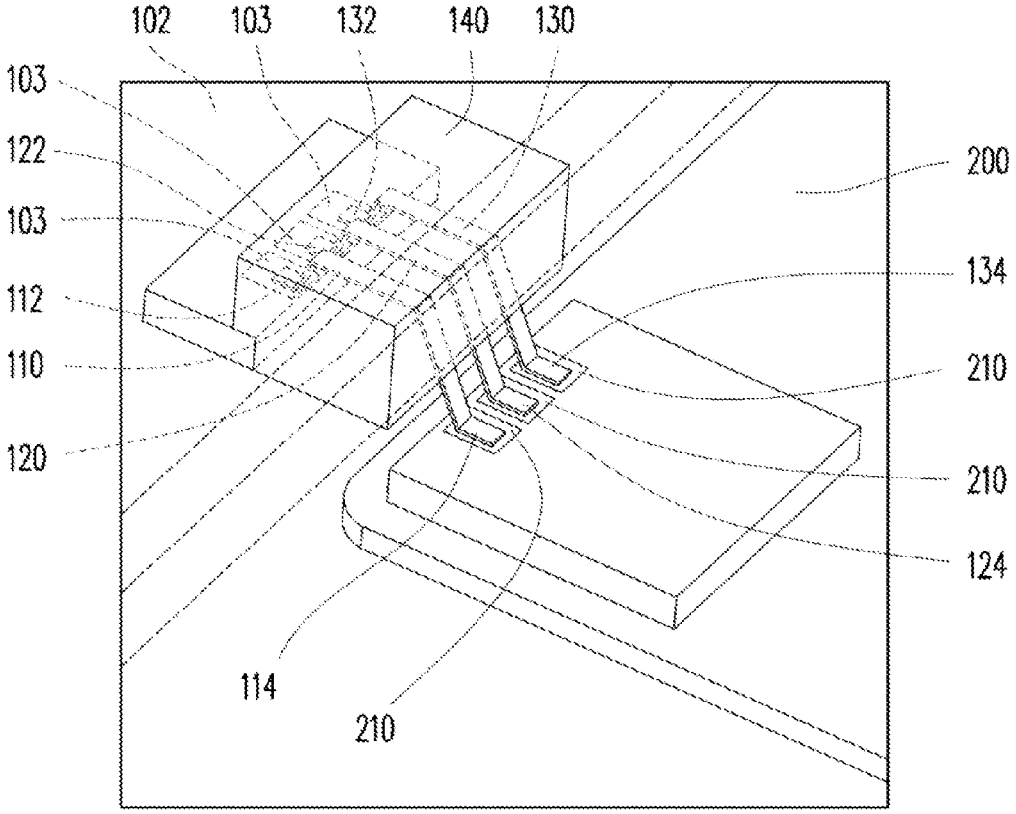
FIG. 2 is an enlarged view of partial of the connector in FIG. 1.

FIG. 1 is a partial perspective showing a first electronic device of an electronic system that is electrically connected to a second electronic device via a connector in an embodiment. FIG. 2 is an enlarged view of partial of the connector connecting two electronic devices in FIG. 1. Please refer to FIG. 1 and FIG. 2, in the embodiment, an electronic system 100 includes a first electronic device 102, a second electronic device 200 and a connector 104. In the embodiment, the first electronic device 102 includes a plurality of first connection points 103, and the second electronic device 200 includes a plurality of second connection points 210. The connector 104 includes a first grounding terminal 110, a signal terminal 120 and a second grounding terminal 130. The signal terminal 120 is between the first grounding terminal 110 and the second grounding terminal 130. In an embodiment, the first grounding terminal 110, the signal terminal 120 and the second grounding terminal 130 is made of conducting materials, such as a metal material.

In the embodiment, the first grounding terminal 110 includes a first end 112 and a second end 114. The signal terminal 120 includes a third end 122 and a fourth end 124, and the second grounding terminal 130 includes a fifth end 132 and a sixth end 134. The first end 112, the third end 122 and the fifth end 132 are electrically connected to the first electronic device 102, respectively. The second end 114, the fourth end 124 and the sixth end 134 are electrically connected to the second electronic device 200, respectively.

In the embodiment, the first end 112, the third end 122 and the fifth end 132 are electrically connected to one of the first connection points 103 by welding or other methods, respectively. When the first electronic device 102 is connected to the second electronic device 200, the second end 114, the fourth end 124 and the sixth end 134 are electrically connected to one of the second connection points 210, respectively.

In an embodiment, the second electronic device 200 includes an accommodation slot 220 to accommodate the first electronic device 102. In detail, after the first electronic device 102 is accommodated in the accommodation slot, the first electronic device 102 is integrated to the second electronic device 200 to have a smooth appearance. In the embodiment, the first electronic device 102 is an electronic communication product, such as a phone.

Figure 3:
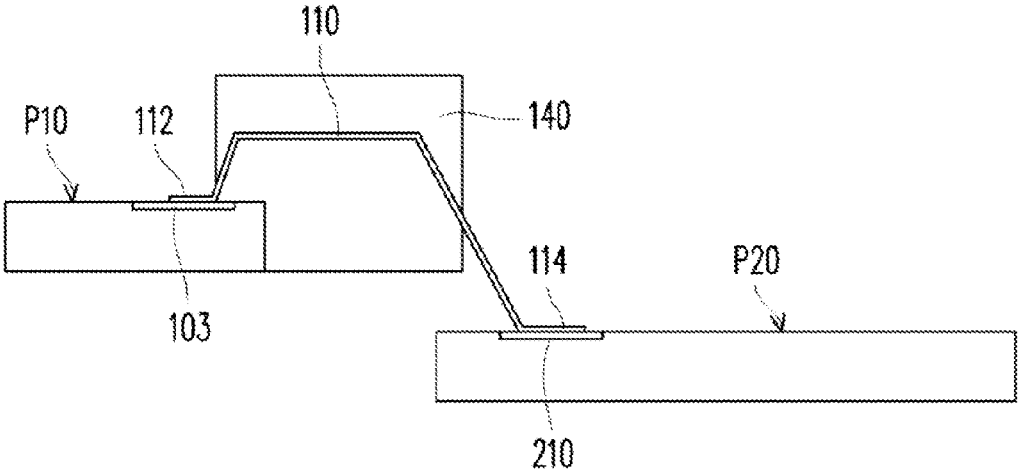
FIG. 3 is a side view of partial of the connector in FIG. 1.

FIG. 3 is a side view of partial of the connector in FIG. 1. Please refer to FIG. 2 and FIG. 3, the first connection points 103 are at a first plane P10 of the first electronic device 102, and the second connection points 210 are at a second plane P20 of the second electronic device 200. The first plane P10 and the second plane P20 are not coplanar. That means, in the embodiment, the connector 104 can be connected to connection points at different planes, and signals are transmitted among the connection points at different planes. Additionally, to conform to the coplanar waveguide theory, the first end 112, the third end 122 and the fifth end 132 are at the same plane, and they are electrically connected to the first connection points 103 at the first plane P10, respectively. Similarly, to conform to the coplanar waveguide theory, the second end 114, the fourth end 124 and the sixth end 134 are at the same plane, and they are electrically connected to the second connection points 210 at the second plane P20, respectively.

In the embodiment, the first grounding terminal 110 and the second grounding terminal 130 may be equipotential. On the other hand, in the embodiment, the signal terminal 120 may be a high frequency signal terminal used to transmit high frequency signals. Since the signal terminal 120 is between the first grounding terminal 110 and the second grounding terminal 130, the first grounding terminal 110 and the second grounding terminal 130 can be the shields for the signal terminal 120, it can avoid that the signals transmitted by the signal terminal 120 is interfered by external disturbance. In detail, since the first grounding terminal 110 and the second grounding terminal 130 are equipotential, a certain potential difference is maintained between the first grounding terminal 110 and the signal terminal 120, and also between the second grounding terminal 130 and the signal terminal 120. As a result, grounding lines surround a signal line, and then the signal transmission quality of the signal line is maintained, and the loss of signals is avoided.

In order to increase a contacting area to maintain stability of the electrical connection, in the embodiment, the first end 112, the third end 122, the fifth end 132, the second end 114, the fourth end 124 and the sixth end 134 are flat-shaped, which is not limited herein, the shape can be adjusted according to requirements and the space.

In the embodiment, the connector 104 further includes a casing 140. The first grounding terminal 110, the signal terminal 120 and the second grounding terminal 130 are partially disposed inside the casing 140. The casing 140 can be used to prevent the first grounding terminal 110, the signal terminal 120 and the second grounding terminal 130 from moisture erosion, and it can also avoids the deformation of the first grounding terminal 110, the signal terminal 120 and the second grounding terminal 130.

In conclusion, according to the connector and the electronic system in the embodiments, the signal terminal is between the first grounding terminal and the second grounding terminal, and the first grounding terminal and the second grounding terminal can shield external disturbance to avoid the interference on the high frequency signal transmitted by the signal terminal. In addition, the terminal of the connector can be adjusted in the three-dimensional stereoscopic space, and thus the connection points at different planes can be connected, which can easily meets the customized requirements.

Although the description is made with reference to certain preferred embodiments thereof, the disclosure is not limiting. Persons having ordinary skill in the art may make various modifications and changes without departing from the spirit and the scope of the disclosure. Therefore, the scope of the appended claims should not be limited to the description of the embodiments described above.

What is claimed is:

1. A connector comprising:

a first grounding terminal including a first end and a second end;

a signal terminal including a third end and a fourth end; and a second grounding terminal including a fifth end and a sixth end, wherein the signal terminal is between the first grounding terminal and the second grounding terminal, wherein the first end, the third end and the fifth end are electrically connected to a first plane of a first electronic device, wherein the second end, the fourth end and the sixth end are electrically connected to a second plane of a second electronic device, and wherein the first plane and the second plane are not coplanar;

wherein the connector is used to connect together the first electronic device and the second electronic device, which is capable of operating independently from the first electronic device.

2. The connector according to claim 1, wherein the first grounding terminal and the second grounding terminal are equipotential.

3. The connector according to claim 1, wherein the signal terminal is a high frequency signal terminal.

4. The connector according to claim 1, wherein the connector further comprises a casing, and wherein the first grounding terminal, the signal terminal, and the second grounding terminal are partially disposed inside the casing.

5. The connector method according to claim 1, wherein the second electronic device includes an accommodation slot to accommodate the first electronic device.

6. The connector method according to claim 1, wherein the first electronic device is an electronic communication product.

7. An electronic system, comprising:

a first electronic device including a first plane;

a second electronic device including a second plane, wherein the first plane and the second plane are not coplanar; and a connector used to connect together the first electronic device and the second electronic device, which is capable of operating independently from the first electronic device, comprising:

a first grounding terminal including a first end and a second end;

a signal terminal including a third end and a fourth end; and a second grounding terminal including a fifth end and a sixth end, wherein the signal terminal is between the first grounding terminal and the second grounding terminal, wherein the first end, the third end and the fifth end are electrically connected to the first plane, and wherein the second end, the fourth end and the sixth end are electrically connected to the second plane.

8. The electronic system according to claim 7, wherein the first grounding terminal and the second grounding terminal are equipotential.

9. The electronic system according to claim 7, wherein the signal terminal is a high frequency signal terminal.

10. The electronic system according to claim 7, wherein the connector further includes a casing, and wherein the first grounding terminal, the signal terminal and the second grounding terminal are partially disposed inside the casing.

11. The electronic system according to claim 7, wherein the second electronic device includes an accommodation slot to accommodate the first electronic device.

12. The electronic system according to claim 7, wherein the first electronic device is an electronic communication product.

* * * * *